United States Patent [19]

Takashi et al.

[11] 4,406,388

[45] Sep. 27, 1983

[54] METHOD OF CONVEYING STRIP MATERIALS

[75] Inventors: Ono Takashi; Suda Tsuyoshi, both of Nagoya, Japan

[73] Assignee: Daido Tokushuko Kabushiki Kaisha, Japan

[21] Appl. No.: 360,100

[22] Filed: Mar. 19, 1982

[30] Foreign Application Priority Data

Apr. 2, 1981 [JP] Japan ..... 56-49788
Apr. 3, 1981 [JP] Japan ..... 56-50985

[51] Int. Cl.[3] ..... B65H 25/06; B65H 17/32

[52] U.S. Cl. ..... 226/7; 226/97; 34/156

[58] Field of Search ..... 226/7, 95, 97; 34/148, 34/151, 152, 153, 156; 406/10, 12, 19

[56] References Cited

U.S. PATENT DOCUMENTS

| | | | |
|---|---|---|---|
| 3,070,901 | 1/1963 | Allander et al. | 226/97 |
| 3,231,165 | 1/1966 | Wallin et al. | 226/97 |
| 3,741,650 | 6/1973 | Leavitt et al. | 355/91 |
| 3,957,187 | 5/1976 | Puigrodon | 226/7 |
| 3,982,327 | 9/1976 | Kurie et al. | 34/156 |
| 4,069,595 | 1/1978 | Ahlbert et al. | 34/156 |
| 4,085,522 | 4/1978 | Stroszynski | 34/156 |

FOREIGN PATENT DOCUMENTS

| | | | |
|---|---|---|---|
| 623570 | 7/1961 | Canada | 226/7 |
| 177847 | 1/1962 | Switzerland | 226/7 |

*Primary Examiner*—Leonard D. Christian
*Attorney, Agent, or Firm*—William A. Drucker

[57] ABSTRACT

Method for conveying strip materials in a floated manner whereby a strip is allowed to pass between a pair of chambers vertically spaced apart from each other and provided with a plurality of jets or blow-off openings at one surface thereof so that jets of gases are blown therefrom against the strip so as to float the strip. If the strip to be conveyed is of a smaller width, then the width of gases blown from the lower chamber are correspondingly reduced so that a saving of energy required for blowing the gases may be achieved.

6 Claims, 24 Drawing Figures

METHOD OF CONVEYING STRIP MATERIALS

BACKGROUND OF THE INVENTION

1. Field of the Invention

This invention relates to methods of continuously conveying strips of metal such as aluminum or of many other different materials in a floated manner.

2. Description of the Prior Art

When a strip of metal or other different material is passed through a heat-treatment apparatus, the strip is floated by a blowoff chamber which blows jets of gases against the strip from a plurality of blowoff openings provided through an upper surface of the chamber. The blowoff openings are arranged in such a number and manner that all the strips of up to maximum width to be treated are floated thereby.

The required capacity of a device for supplying the strip-floating gases to the blowoff chamber is determined as follows:

$$V = \sqrt{\frac{\alpha t}{B}} \quad (1)$$

(where V is the blowoff speed of strip-floating gases; t, thickness of the strip; $\alpha$, coefficient; and B is width of the strip.)

That is, the smaller the width of the strip, the higher blowoff speed of strip-floating gases is required, and it is required for the device to have such a maximum supply rate as allows the gases to blow off through the blowoff chamber, from all the blowoff openings thereof, at the highest speed which causes the strip of smallest width to be floated.

With reference to FIG. 7 of the accompanying drawings, if the blowoff chamber of 2,029 mm. in width is required to blow gases at a supply rate of 500 $Nm^3$ in order to float a strip of 1,829 mm. in width, the same chamber must blow off the gases at a supply rate of approximately 870 $Nm^3$ per minute in order to float a strip of 610 mm. in width. Therefore, if the strips to be heat treated are of widths of 610 mm. to 1,829 mm., the device for supplying the strip-floating gases to the blowoff chamber is required to have a considerably great supply capacity, i.e., maximum supply rate of 870 $Nm^3$ in order to float all the strips to be treated.

SUMMARY OF THE INVENTION

It is an object of the invention to provide a method of conveying strips of metal or other different materials which is characterized in floating the strips in an equally reliable manner, whether they are larger or smaller in width, while conveying them.

Another object of the invention is to provide a method of conveying strips of metal or other different materials which is characterized in that the smaller the width of the strip to be conveyed, the smaller the rate of supply of gases required for floating the strip although the strips, whether of a larger or smaller width, are floated in an eually reliable manner. When this object is achieved, a means for supplying the strip-floating gases to a blowoff chamber may be of a lighter duty than required if otherwise.

Other objects and advantages of the invention will become apparent during the following discussion of the accompanying drawings.

DESCRIPTION OF THE PREFERRED EMBODIMENTS

Figure 1:
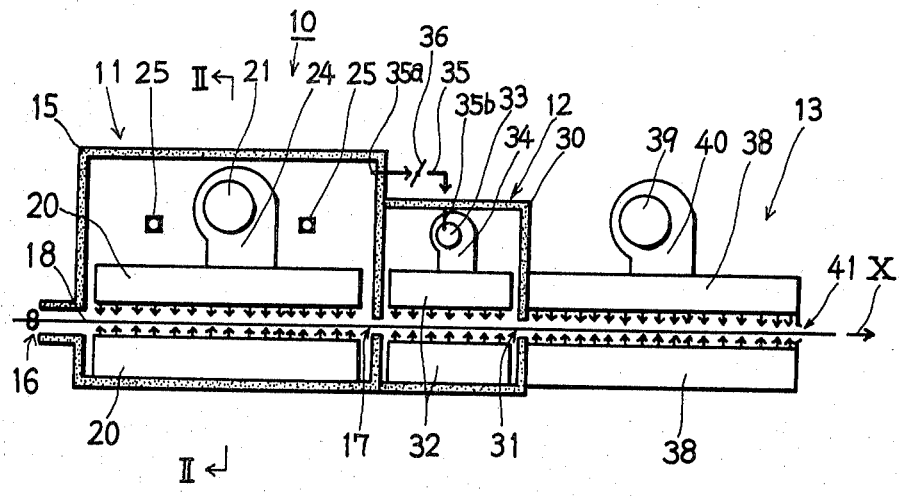
FIG. 1 is a schematic vertical cross section of a heat-treatment apparatus according to the invention.
Figure 2:
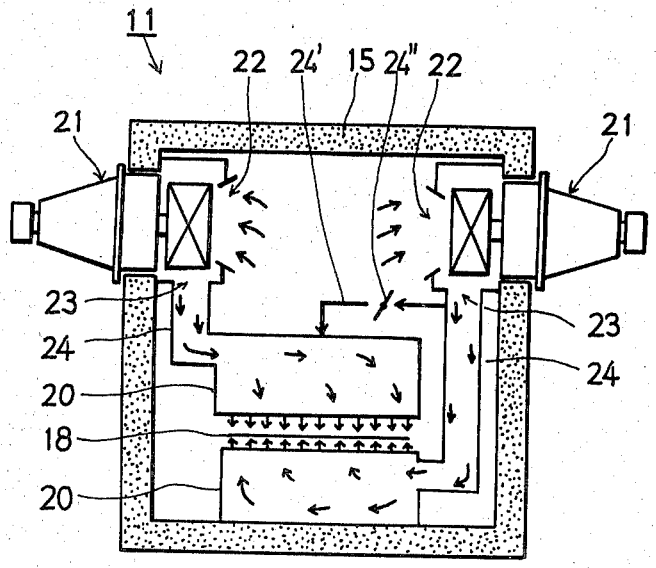
FIG. 2 is another vertical cross section of the apparatus of FIG. 1 taken on the line II—II of FIG. 1.

Referring to FIGS. 1 and 2, an apparatus 10 for heat-treating metal strips comprises a heating device 11, slow-cooling device 12, and full-cooling device 13.

The heating device 11 is defined by a furnace wall 15 which, as is well known in the art, is so constructed as to isolate heat inside and outside the device 11 from each other and is provided with an introduction port 16 and an insertion opening 17 which allow a metal strip 18 to be inserted therethrough. The heights of the port 16 and opening 17 are so determined that the metal strip 18 is allowed to pass therethrough with no damage given to the strip 18 and that the amount of gases passing therethrough is minimized. Also, the widths of the port 16 and opening 17 are so determined that the widest strip of all the metal strips to be heat-treated is passed therethrough with no damage given to the strip.

Inside the furnace wall 15 are provided a pair of plenum chambers 20 vertically spaced apart from each other so that the strip 18 is allowed to pass therethrough. The upper and lower plenum chambers 20 are provided with a plurality of openings (designated by numeral 57 in FIG. 9) made through the bottom and the top thereof, respectively, for blowing jets of gases against the strip 18. The plenum chambers 20 each have a width larger than the widest strip of all the metal strips to be heat-treated. Also the breadth-wise distribution of the blowoff openings of each chamber 20 is such that the openings cover a range slightly larger than the breadth of the foregoing widest strip.

The furnace wall 15 is also provided with a pair of gas-supply means such as circulating fans 21 extending through the wall 15 and each having an intake port 22 and supply port 23 (FIG. 2). As clearly shown in FIG. 2, a blast duct 24 is connected to the supply port 23 of one circulating fan 21 at one end thereof and to the upper plenum chamber 20 at the other end thereof, while another blast duct 24 is connected to the supply port 23 of the other circulating fan 21 at one end thereof and to the lower plenum chamber 20 at the other end thereof. In FIG. 2 the right-hand blast duct 24 and the left-hand one 24 therefore are adapted to supply gas (from the circulating fans 21) to the upper chamber 20 and the lower chamber 20, respectively. However, the left-hand circulating fan 21 and blast duct 24 may not be provided if instead of them 21 and 24 a blast duct 24' is connected to the supply port 23 of the right-hand circulating fan 21 at one end thereof and to the upper chamber 20 at the other end thereof so that the two right-hand blast ducts 24' and 24 supply gas to the upper chamber 20 and to the lower chamber 20, respectively. In such a case, the blast duct 24' may be provided with a dumper 24' to be opened in the required amount for the suitable rate of supply of gas to the upper chamber 20.

As with the heating device 11, the slow-cooling device 12 includes a furnace wall 30, an insertion opening 31, a pair of plenum chambers 32, a pair of circulating fans 33, and their associated blast ducts 34. The circulating fans 33 each have an intake port connected to one end **35*b* of heated-gas supply pipe 35 which is connected to and opened into the heating device 11 at the other end 35*a* thereof so that the gas heated in the device 11 is allowed to stream therethrough to the fan 33. The heated-gas supply pipe 35 is provided, at a middle portion thereof, with a dumper 36 for controlling the amount of the heated gas to be supplied to the fan 33 or slow-cooling device 12**.

The third component or full-cooling device 13 is of a similar construction to that of the heating device 11 except that no furnace wall or burners are provided; that is, the full-cooling device 13 includes a pair of plenum chambers 38, a pair of air-blast fans 39, their associated blast ducts 40, and strip-discharge opening 41.

In FIG. 1 it is to be noted that only one of each pair of circulating fans (21, 33, and 39) is shown.

Figure 3:
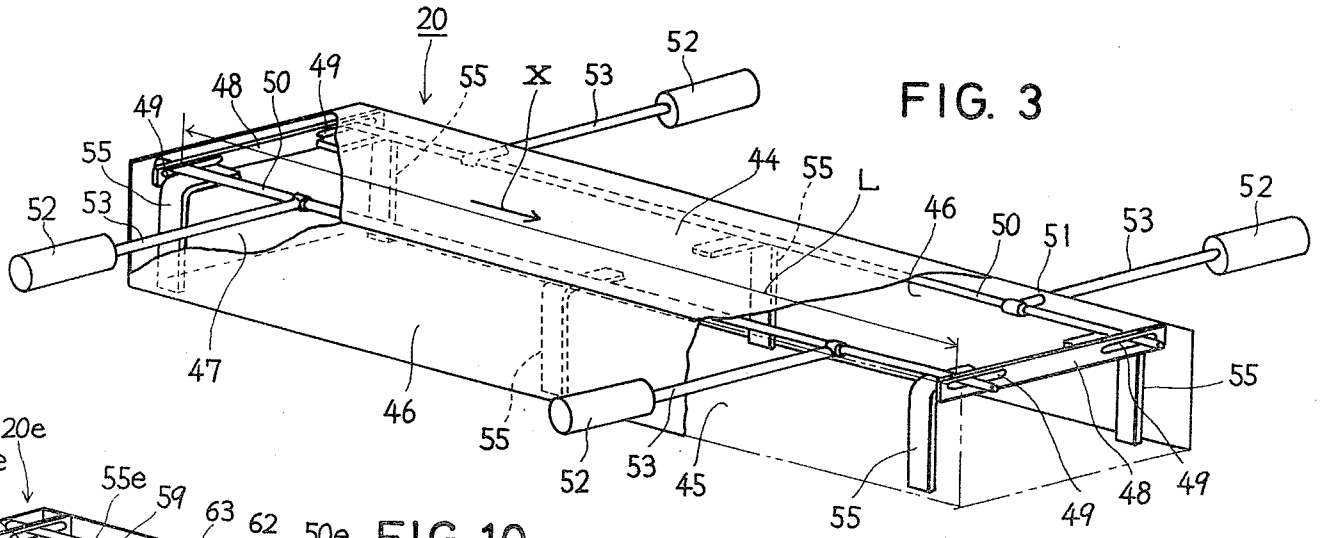
FIG. 3 is a partially-broken perspective view of one of two plenum chambers used in a heating device provided in the apparatus of FIG. 1.
Figure 4:
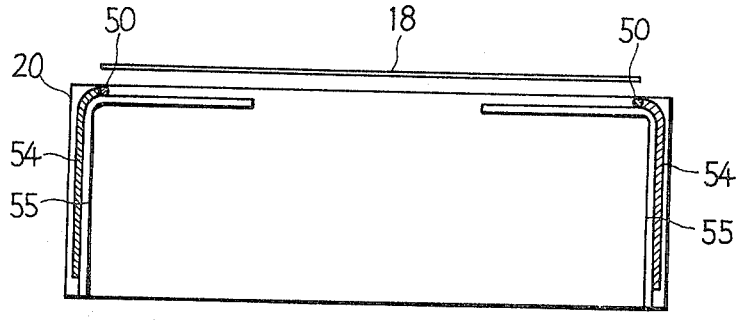
FIGS. 4, 5, and 6 each shows a strip material in heat treatment by the apparatus of FIG. 1 and a lower one of the two plenum chambers floating the strip material with a particular gas-blow width suitable for the particular width of the material.

Referring to FIG. 3, the lower one of the two plenum chambers 20 in the heating device 11 (which chamber 20, when turned upside down, is identical with the upper chamber 20 in construction) is of a box-shaped construction comprising a top plate 44, bottom plate 45, and side plates 46 and 47. As previously mentioned, the top plate 44 is provided with a plurality of blowoff openings (although not shown in FIG. 3). A pair of support plates 48 are connected to the inside surfaces of top plate 44 and side plates 46. Each support plate 48 has a pair of guide holes 49 each of which allows a bar 50 to pass therethrough at one end thereof. Each bar 50 therefore is inserted through the two opposite guide holes 49 and supported by the two opposite support plates 48 at both ends thereof. A pair of cylinders 52 including advance/retreat rods 53 are connected to each bar 50 through installation holes 51 made through the side plate 46 and each allowing the piston rod 53 to pass therethrough. Outside the plenum chamber 20 the cylinders 52 are also supported by cylinder supports (not shown) at their respective outside ends. Each piston rod 52 is adapted to move at right angles to the side plate 46 so as to displace the bar 50 along the guide holes 49. Each bar 50 is provided with a shutter 54 connected to the substantially entire length of the bar 50 (i.e., the range indicated by L in FIG. 3) so as to move together with the bar 50 when the bar is displaced along the guide holes 49 by the piston rods 53. Such movements of the bars 50 and shutters 54 are shown in FIGS. 4 (retracted position), 5, and 6. When the shutters 54 are thus moved (FIGs. 5 and 6), all of the blowoff openings of the top plate 44 then located directly above the shutters are closed. Therefore, the cylinders 52, bars 50, and shutters 54, as major components, constitute a gas-blowoff width adjusting mechanism.

The plenum chambers 32 of the slow-cooling device 12 and those 38 of the full-cooling device 13 are of a construction identical to those of the plenum chambers 20 of the heating device 11, and no description will be given to the construction of the chambers 32 and 38.

Referring again to FIGS. 1 and 2, the apparatus 10 of the above-mentioned construction is operated as follows: In the heating device 11 the burners 25 are operated to heat the atmosphere in the device 11, and the circulating fans 21 are also operated so that the heated gas is drawn from their intake ports 22 and supplied into the plenum chambers 20 through the supply ports 23 and blast ducts 24. From the chambers 20 the gas is blown off through their blowoff openings to the passage of the strip 18 between the two chambers 20. In the slow-cooling device 12 moderately warm gas is blown from the plenum chambers 32 in the same manner as in the first device 11. In the full-cooling device 13, cooling air of the normal temperature is blown from the plenum chambers 38 in the same manner as in the first device 11. Into the heat-treatment apparatus 10 thus operated is inserted the metal strip 18 as shown in FIG. 1. The strip 18 inserted is conveyed by a conveyance mechanism (not shown) in a direction indicated by X in FIG. 1 while being floated by the gases blown from the plenum chambers 20, 32, and 38.

When the metal strip 18 is thus passed through the apparatus 10, the strip 18 is first heated to a high temperature (e.g., 450° C.) by the heating gas blown from the plenum chambers 20 of the first device 11, and is then cooled, with a gentle temperature gradient, to a medium temperature (e.g., 250° C.) by the moderately warm gas blown from the plenum chambers 32 of the second device 12. Lastly the strip 8 is cooled, with a sharp temperature gradient, to the normal temperature by the cooling gas blown from the plenum chambers 38 of the third device 13.

Description is then given to different operations to be made for the particular widths of the metal strips to be conveyed.

(1) For the widest one of all the strips to be conveyed

For the conveyance of the widest metal strip, the shutters 54 are held in their fully-retracted positions, as shown in FIG. 4, so that no blowoff openings of the chamber top 44 are closed by the shutters 54. In addition, the supply rate of the heated gas by the circulating fans 21 is set at the predetermined maximum rate for the maximum strip width.

Under these conditions the heating gas is blown from all the blowoff openings of the plenum chambers 20 against the strip 18 at the optimum speed for floating the strip. The strip is therefore allowed to travel in the direction X (FIG. 1) in a steadily-floated condition.

(2) For a strip of medium width

Figure 5:
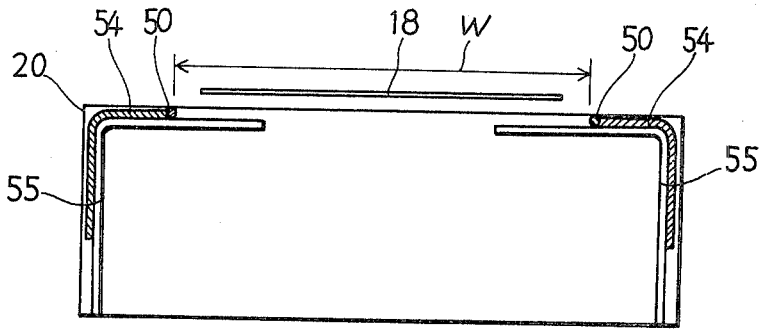

For the conveyance of a strip of medium width or a little smaller width than that of the widest strip, the shutters 54 both are moved inward by a certain amount so that some of the blowoff openings of the chamber 20 are closed, setting the gas blowoff-width at a range W as shown in FIG. 5. As clearly shown in FIG. 5, the blowoff width W preferably is slightly larger than the width of the strip; for example, if the strip is of a width of 1,200 mm., the blowoff width W is preferably 1,400 mm.

For the conveyance of such a strip, the supply rate of the heating gas of the circulating fans 21 is determined as follows: The smaller the width of the strip, the higher blowoff speed of the gas is required in order to float the strip. If the gas-supply rate of the fans 21 is set at the same as in the foregoing case (1) for the gas-blowoff width W of FIG. 5, the blowoff speed of the gas from the chambers 20 is increased compared with that of the case (1), but exceeds the optimum speed for floating the strip (of FIG. 5). Therefore, the supply rate of gas of the fans 21 must be reduced to such a degree that the the blowoff speed of the gas from the chambers 20 becomes the optimum one for floating of the strip. One of the methods of reducing the gas-supply rate of the fans is to reduce the electric power supplied to the electric motor for operating the fans.

With the gas-blowoff width set at W and the gas-supply rate of the fans 21 determined in the foregoing manner, the strip of medium width is conveyed in a steadily-floated condition.

(3) For a strip of smaller width

Figure 6:
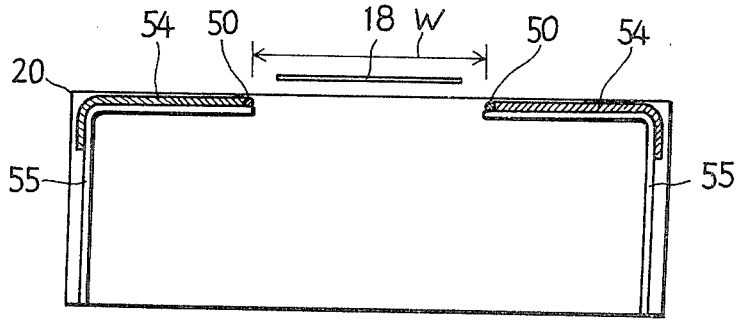

For the conveyance of a strip of considerably smaller width such as one shown in FIG. 6, the shutters 54 are moved more inward than in the foregoing case (2) so that the gas-blowoff width W becomes further reduced (FIG. 6). As in the case (2), the gas-blowoff width W preferably is a little larger than the width of the strip; for example, if the strip is of a width of 610 mm., the blowoff width W may be preferably 800 mm. or so. In addition, the gas-supply rate of the fans 21 is so adjusted that the gas-blowoff speed becomes the optimum one for floating the strip.

Under these conditions the strip of smaller width is conveyed in a steadily-floated manner.

In the foregoing cases (2) and (3) it is to be noted that since no surplus gas is supplied from the circulating fans 21, a saving of the electric power required for operating the fans is achieved.

After passing through the heating device 11 in the foregoing manner, the foregoing each strip of the particular width is then conveyed through the slow-cooling device 12 and full-cooling device 13 in the same manner as in the heating device 11.

Figure 7:
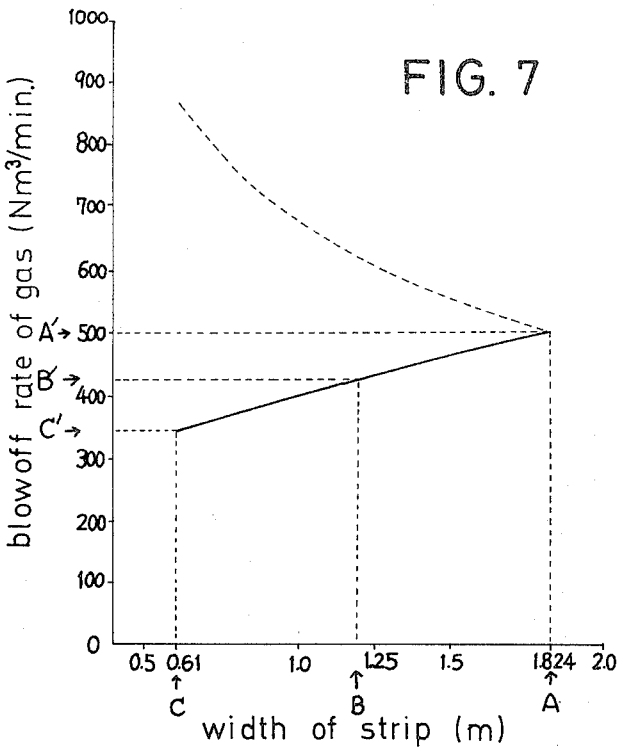
FIG. 7 is a graph showing the relationship between the widths of strips and the supply or blowoff rate of gas by a fan required for floating the strips.

Referring to FIG. 7 showing a relationship between the widths of metal strips and the supply rate of gas of the circulating fan required for the steady floating of the strips, if a strip of the width indicated by A in FIG. 7 (which is the width of the strip of FIG. 4) is to be floated by the plenum chamber 20 of FIG. 3, the circulating fan must have a gas-supply rate indicated by A' of FIG. 7. Also, if the strip to be floated is of a smaller width indicated by B of FIG. 7 (which is the width of the strip of FIG. 5), then the gas-supply rate of the fan must be set at the value indicated by B' of FIG. 7 which is smaller than the value A' for the previously-mentioned reason. Lastly, if the strip to be floated is of a still smaller width indicated by C of FIG. 7 (which is the width of the strip of FIG. 6), then the fan must have a gas-supply rate indicated by C' of FIG. 7 which is still smaller than the value B'. Therefore the circulating fans for the apparatus 10 may be designed with the maximum rate of gas supply indicated by the value A'.

It is to be noted that the relationship of FIG. 7 is under the conditions that the plenum chamber is of a length of 8 meters (dimension in the direction of strip conveyance) and that the strips are of a thickness of 0.4 millimeters.

Figure 8:
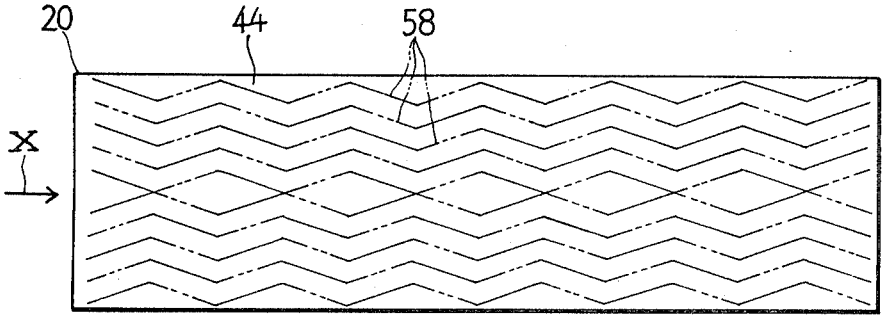
FIG. 8 shows the arrangement or distrubution of blowoff openings provided in one of the two plenum chambers identical to the other chamber in construction.
Figure 9:
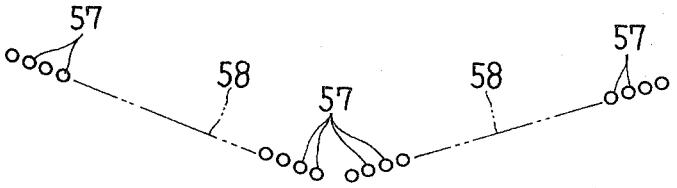
FIG. 9 is an enlarged view of some of the blowoff openings of FIG. 8.

Referring to FIGS. 8 and 9 showing the arrangement or distribution of the blowoff openings 57 of the chamber top 44, the blowoff openings 57 are located, in small groups, on a plurality of imaginary zigzag lines drawn along the lengthwise direction of the top plate 44 or the strip-conveyance direction X. Such an arrangement of the blowoff openings 57 allows the openings to be closed or opened by a small number at a time as the shutters 54 are moved inward or outward of the chamber 20, so that the gas-blowoff width W of the top plate 44 may be varied by a small amount at a time for a wide variety of strip widths.

Figure 10:
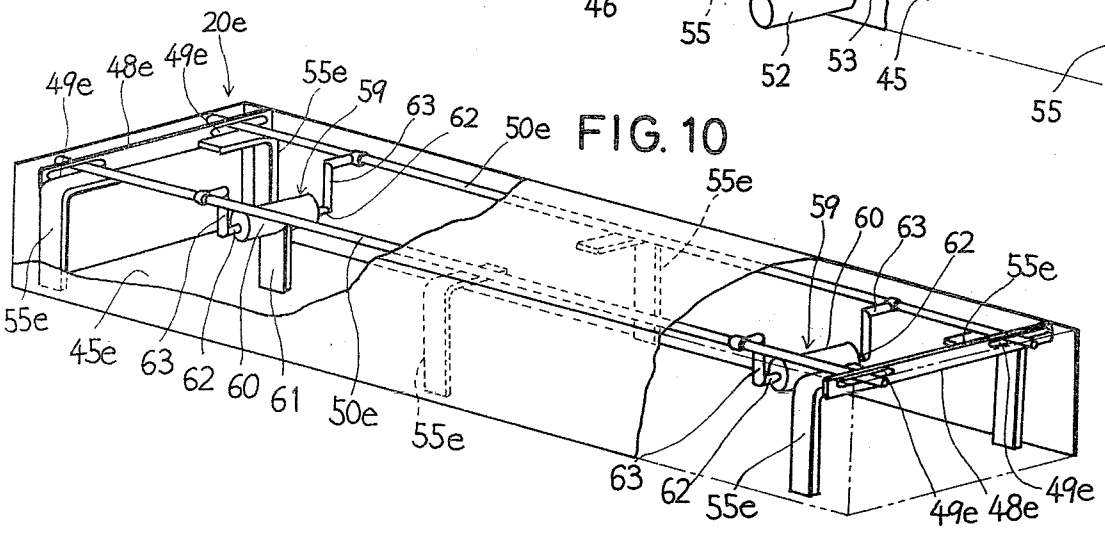
FIG. 10 is a partially-broken perspective view of another embodiment of a plenum chamber different from the preceding ones in a gas blowoff-width adjusting mechanism.

Referring to FIG. 10, a plenum chamber 20*e* is different from the preceding one 20 (32 or 38) in a gas blowoff-width adjusting mechanism. That is, the adjusting mechanism herein includes a pair of cylinders 59 disposed inside the chamber 20*e*. The cylinders 59 each have a cylinder body 60 connected to a bottom plate 45*e* of the chamber by means of an upright support 61 and have a pair of piston rods 62 connected to a pair of bars 50*e*, respectively, by means of a pair of angular supports 63. The piston rods 62 are adapted to move at right angles to the direction of strip conveyance in a simultaneous and symmetrical manner so that the bars 50*e*, together with shutters (not shown) connected thereto, are moved in a simultaneous and symmetrical manner.

In the foregoing second embodiment of gas blowoff-width adjusting mechanism and the similar embodiments that follow hereinafter, parts or portions exactly or substantially identical to those of the foregoing first embodiment 20 are designated by the same numerals as those of the preceding portions and alphabets e, f, g, h, and i.

Figure 11:
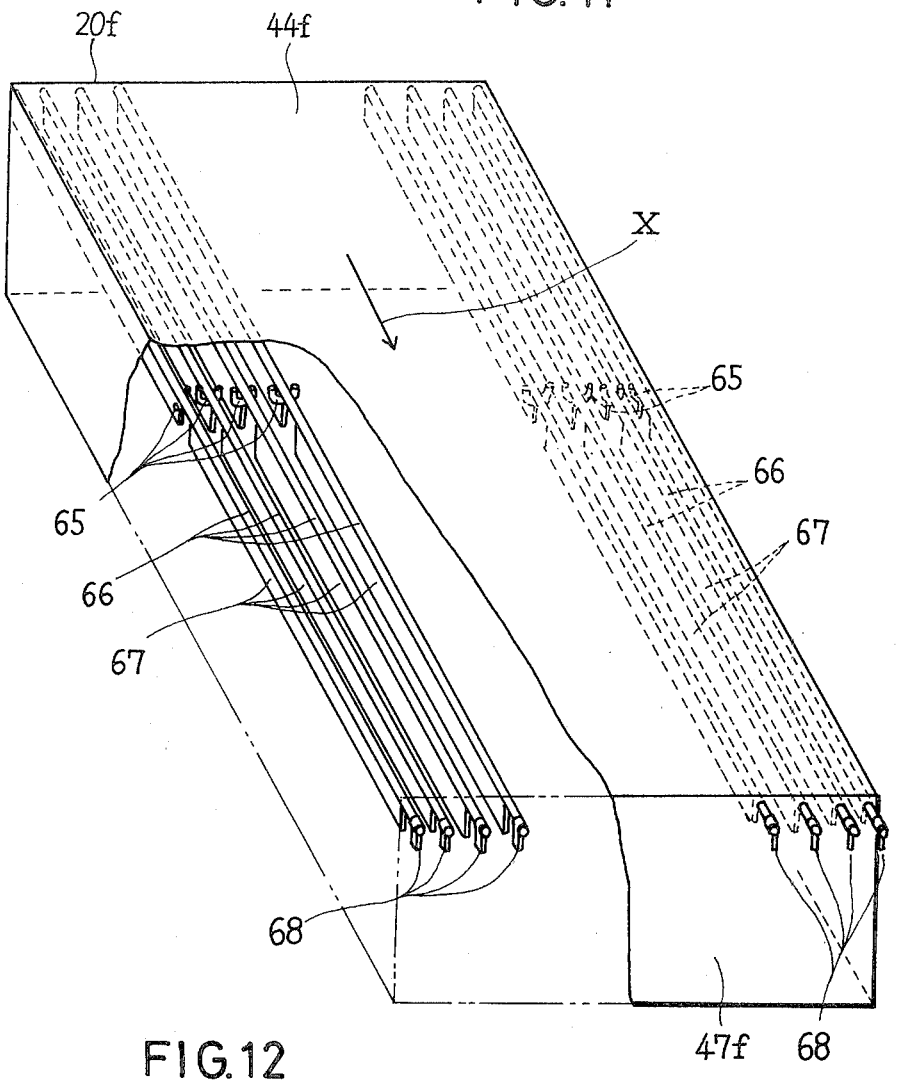
FIG. 11 is also a partially-broken perspective view of a further embodiment of a plenum chamber different from the preceding ones in the gas blowoff-width adjusting mechanism.
Figure 12:
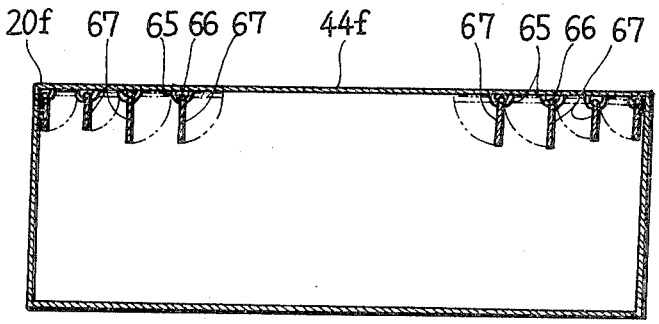
FIG. 12 is a vertical cross section of the mechanism of FIG. 11.
Figure 13:
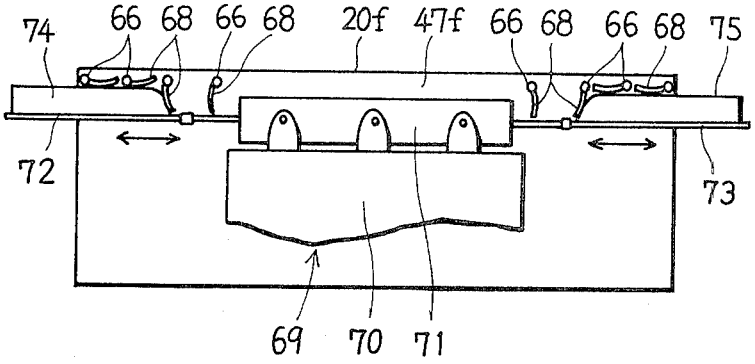
FIG. 13 is a side elevation of the mechanism of FIG. 11.

Referring to FIGS. 11, 12, and 13, a plenum chamber **20*f* is also different from the preceding ones in a gas blowoff-width adjusting mechanism. The plenum chamber 20*f* herein includes a pair of groups of bars 66 which are rotatably supported, beneath a top plate 44*f*, by bearings 65 and each are provided with a shutter means 67. Each bar 66 projects from one side plate 47*f* at one end thereof, and the projecting end is provided with a contact piece 68. When being in upright positions as shown in FIGS. 11 and 12, the shutter means 67 close no blowoff openings of the top plate 44*f*, but are adapted to close them when the means 67 are rotated to the horizontal positions by a shutter-operating means 69 which includes a base 70 and an air cylinder 71. The air cylinder 71 is provided with a pair of piston rods 72 and 73 having shutter-operating plates 74 and 75, respectively, on the upper surfaces thereof. The piston rods 72 and 73 are adapted to move at right angles to the direction of strip conveyance in a simultaneous and symmetrical manner, so that when the shutter-operating plate 74 on the rod 72 is moved to the right-hand side in FIG. 13, the opposite plate 75 is moved to the left-hand side in the same Fig. As is clearly shown in the same Fig., when these plates 74 and 75 are thus moved, the contact pieces 68 of the bars 66 are rotated to the horizontal positions successively with the most outward first and the most inward last, so that the shutter means 67 (not shown in FIG. 13) of the bars 66 are simultaneously rotated to the horizontal positions, successively closing the blowoff openings of the top plate 44*f*. The gas-blowoff width of the top plate 44*f*** is thus adjusted.

Figure 14:
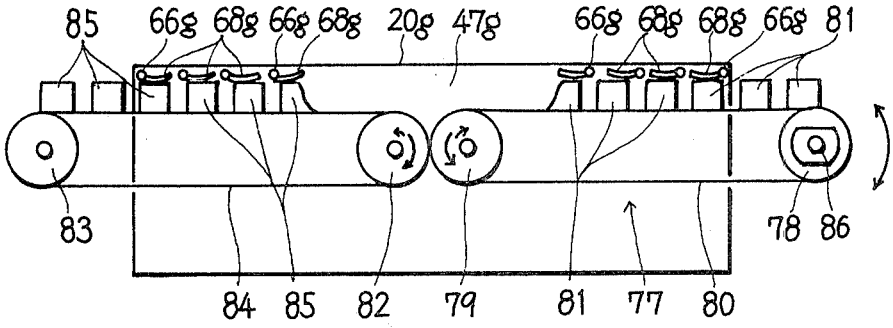
FIG. 14 is a side elevation of a still another embodiment of a plenum chamber different from the preceding ones in the gas blowoff-width adjusting mechanism.

Referring to FIG. 14, a plenum chamber **20*g* is also different from the preceding ones in a gas blowoff-width adjusting mechanism. More particularly, the plenum chamber 20*g* is different from the preceding chamber 20*f* in a shutter-operating means 77 of the gas blowoff-width adjusting mechanism. The shutter-operating means 77 (corresponding to the means 69 of the preceding chamber 20*f*) includes a pair of sprockets 78 and 79 carrying a chain 80 which is provided with a plurality of shutter-operating pieces 81, and also includes a pair of sprockets 82 and 83 carrying a chain 84 which is provided with a plurality of shutter-operating pieces 85. A reversible motor 86 is connected to the sprocket 78. The sprockets 79 and 82 are engaged with each other. In this construction, when the reversible motor 86 is rotated in a counterclockwise direction (in FIG. 14), the sprockets 78 and 79 are also rotated in the same direction with the shutter-operating pieces 81 of the chain 80 successively rotating contact pieces 68*g* to the horizontal positions, while the sprockets 82 and 83 are rotated in the clockwise direction with the shutter-operating pieces 85 of the chain 84 successively rotating the other group of contact pieces 68*g* to the horizontal positions. That is, when the motor 86 is operated, the shutter-operating pieces 81 and 85** are moved in a simultaneous and symmetrical manner.

Figure 15:
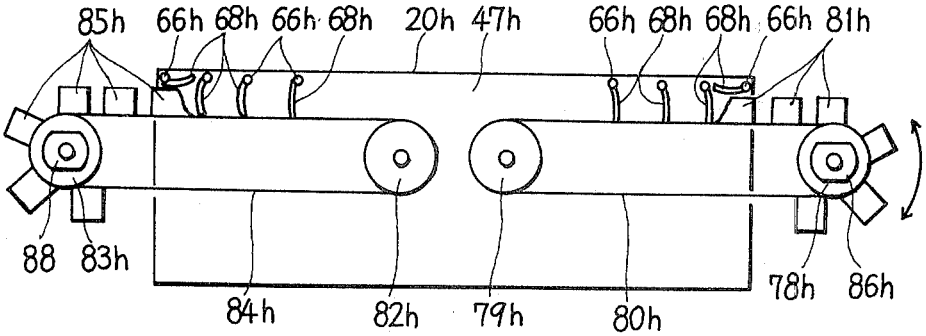
FIG. 15 is also a side elevation of a still further embodiment of a plenum chamber different from the preceding ones in the gas blowoff-width adjusting mechanism.

Referring to FIG. 15, a plenum chamber **20*h* is also different from the preceding ones in a gas blowoff-width adjusting mechanism. More particularly, the plenum chamber 20*h* is different from the preceding chamber 20*g* in that a pair of sprockets 78*h* and 79*h* are separated from another pair of sprockets 82*h* and 83*h* and reversible motors 86*h* and 88 are connected to the sprockets 78*h* and 83*h*, respectively. The reversible motors 86*h* and 88 are adapted to rotate simultaneously or synchronously in the opposite directions. In this construction, when the motor 86*h* is rotated in a counterclockwise direction (in FIG. 15) and the other motor in the opposite direction, shutter-operating pieces 81*h* and 85*h* rotate contact pieces 68*h*** successively to the horizontal positions.

Figure 16:
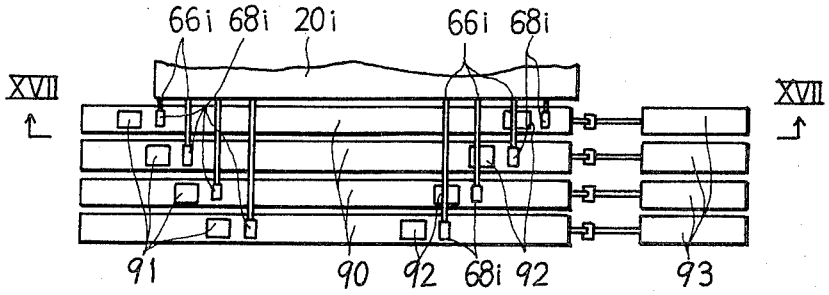
FIG. 16 is a plan view of a still another embodiment of a plenum chamber different from the preceding ones in the gas blowoff-width adjusting mechanism.
Figure 17:
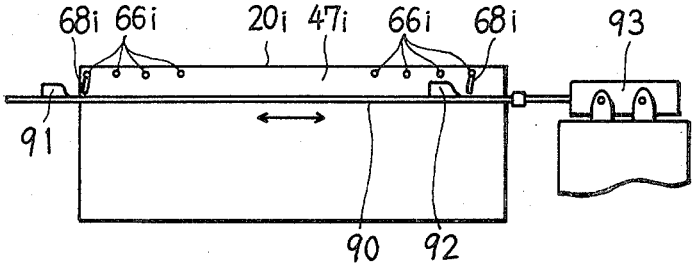
FIG. 17 is a side elevation of the mechanism of FIG. 16.

Referring to FIGS. 16 and 17, a plenum chamber **20*i* is also different from the preceding ones in a gas blowoff-width adjusting mechanism. More particularly, in the adjusting mechanism herein, bars 66*i* of each group project from the chamber 20*i* by different distances and a shutter-operating board 90 is provided for each pair of bar projections having the same length. The shutter-operating board 90 has a pair of shutter-operating pieces 91 and 92 located on the upper surface thereof and adapted to engage with contact pieces 68*i* of the bar projections, and is connected to a cylinder 93 so that the board 90 is moved thereby at right angles to the direction of strip conveyance. Therefore in this mechanism, unlike in those of FIGS. 11 to 15, the shutter means (not shown in FIG. 16) located inside the chamber 20*i*** are operated not symmetrically, but in the same direction.

Figure 18:
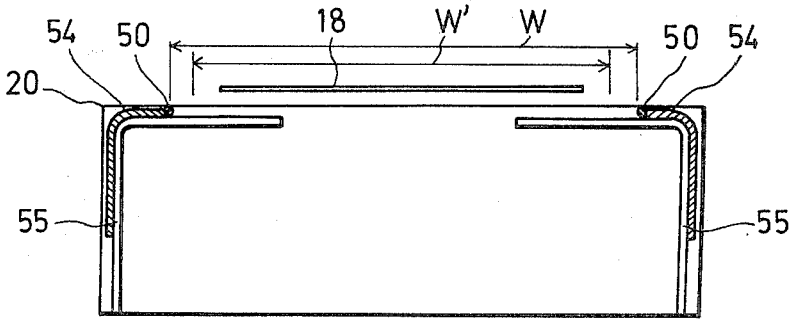
FIGS. 18 and 19 each show a floating relationship between a strip material and the lower plenum chamber, similar to but different from those of FIGS. 5 and 6 in the setting of blowoff width of the strip-floating gas.

Referring to FIGS. 18 (corresponding to FIG. 5) and 19 (corresponding to FIG. 6), another method of floating strips may be carried out as required, instead of the method described in connection with FIGS. 4, 5, and 6; that is, although in the preceding method the supply rate of gas from the circulating fan 21 is varied for the different widths of strips and accordingly-adjusted gas-blowoff width so that the blowoff speed of gas from the chamber becomes the optimum one for floating the strip, the supply rate of gas from the fan may be kept at the same or maximum value (determined for the floating the widest one of all strips to be treated) for floating all the strips of different widths to be treated. And when this method is followed, the gas-blowoff width W (FIG. 18) for a strip 18 (of the same width as the strip of FIG. 5) is set at a larger range than the required blowoff width W' (indicated by W in FIG. 18) in the method of FIG. 5, by a certain amount.

Figure 19:
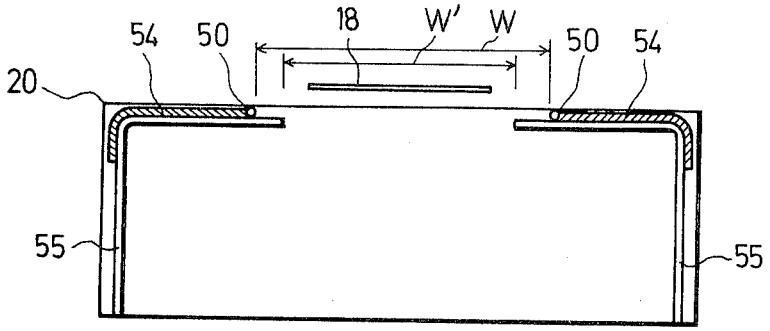
Figure 20:
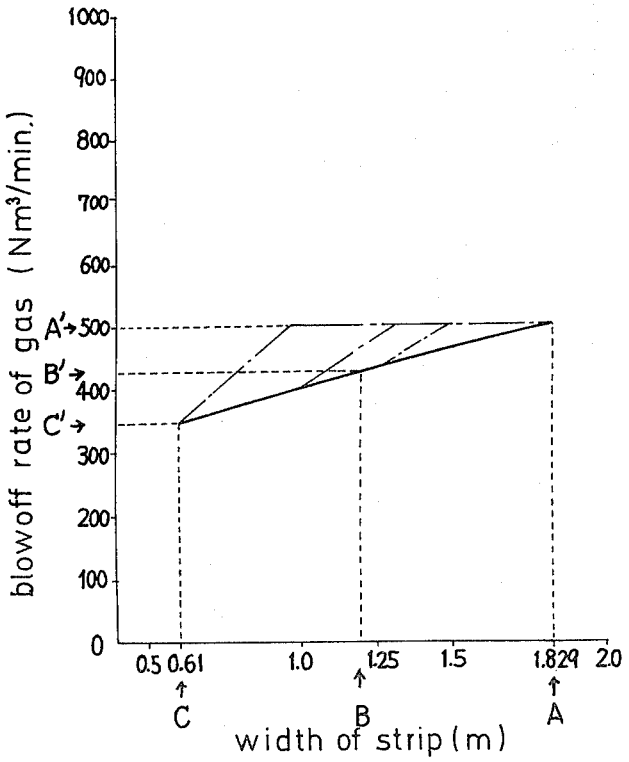
FIG. 20 is a similar graph to that of FIG. 7 but which shows a different relationship between the widths of strips and the blowoff rate of strip-floating gas.

Further referring to FIG. 20 similar to FIG. 7, the gas-blowoff width W of the method of FIG. 18 is so determined that the gas supplied for the strip 18 of a width indicated by B in the maximum amount or rate indicated by A' (set for the widest strip A) floats the strip 18 by the supply rate B' which would be required for the preceding method of FIG. 5, with the remaining portion of the gas (A'-B') discharged from the difference between the blowoff width W and smaller width W', without playing any part in the floating the strip. The blowoff width W of FIG. 19 for a strip 18 of the same width as the strip of FIG. 6 is determined in the same manner as in the method of FIG. 18.

It is to be noted that the relationship of FIG. 20 is under the conditions that the plenum chamber is of a length of 8 meters and that the strips are of a thickness of 0.4 millimeters.

There is more waste of the strip-floating gases in the foregoing alternative floating method compared with the first method of energy-saving type; however, the strip is conveyed by the alternative method with the same degree of steady floating as by the first method. Also, the second method has the advantages that there is no need to vary the gas supply rate of the fan and that, as in the first method, the circulating fan may be designed with the maximum rate of gas supply indicated by A' of FIG. 20. Although the gases discharged without playing any part in the strip floating must be controlled in a slight amount in the second method, such a control may be made easily.

Figure 21:
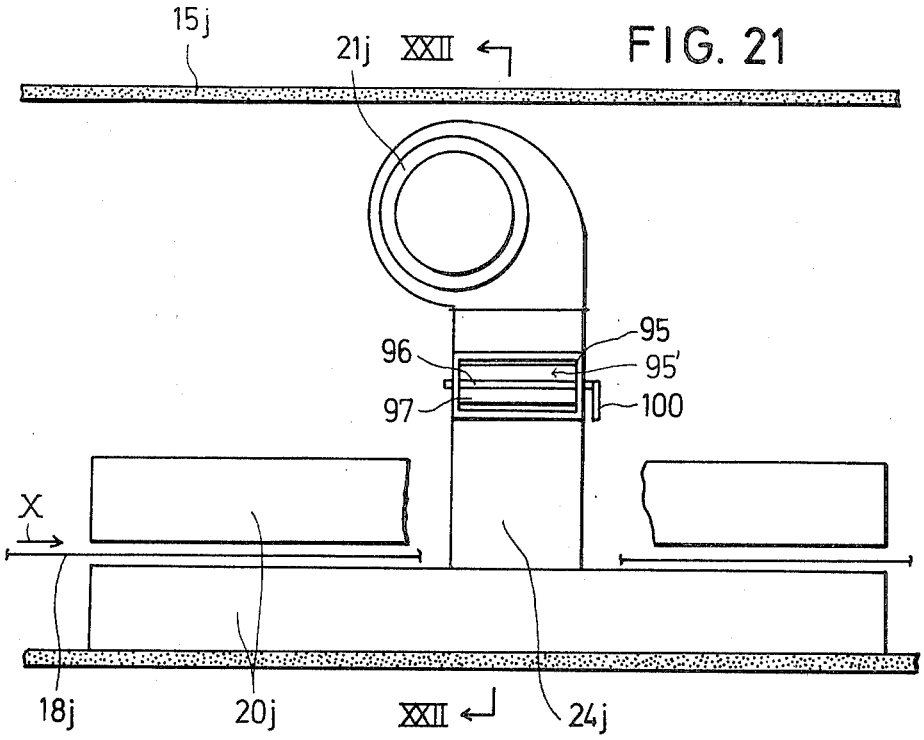
FIG. 21 is a vertical cross section of blast duct and surplus-gas discharge means connected thereto.
Figure 22:
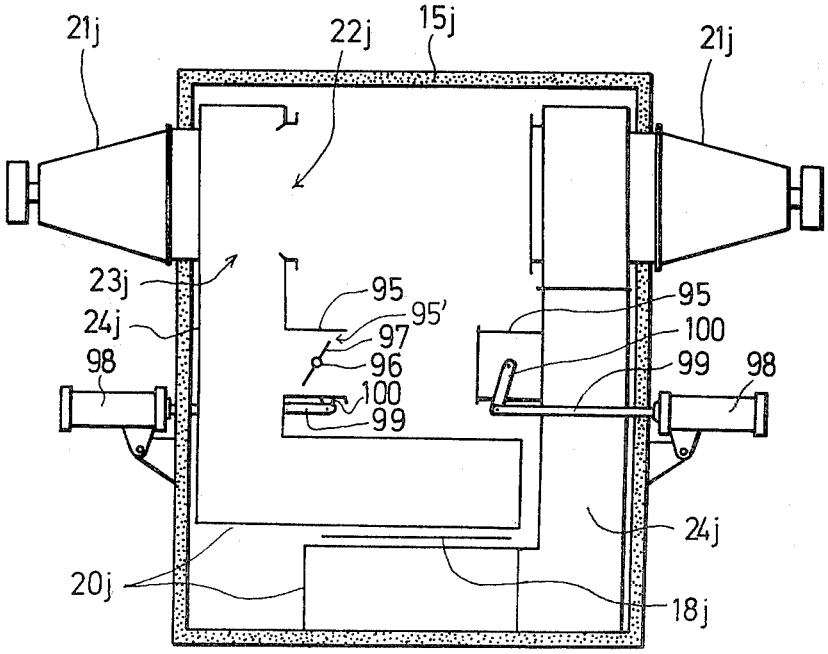
FIG. 22 is a cross section of the duct and discharge means of FIG. 21 taken on the line XXII—XXII of FIG. 21.

Referring to FIGS. 21 and 22, the foregoing surplus gas may be earlier discharged from a blast duct 24*j*, instead of being discharged from the chamber. That is, the blast duct 24*j* includes a surplus-gas discharge means 95 connected thereto in its middle portion and having a rotatable shaft 96 inserted therethrough. The discharge means 95 includes a discharge port 95', and the shaft 96 is provided with a dumper 97 for adjusting the opening amount of the discharge port 95' so as to control the amount of surplus gas to be discharged. The shaft 96 also has a lever 100 outside the discharge means 95 which lever 100 is connected to a piston rod 99 of a cylinder 98 installed onto the outside surface of a furnace wall 15*j*. In such a surplus-gas discharge mechanism, the cylinder 98 is operated to open the dumper 97 in the required amount for discharging the surplus gas from the discharge port 95' into the space enclosed by the furnace wall 15*j*.

Figure 23:
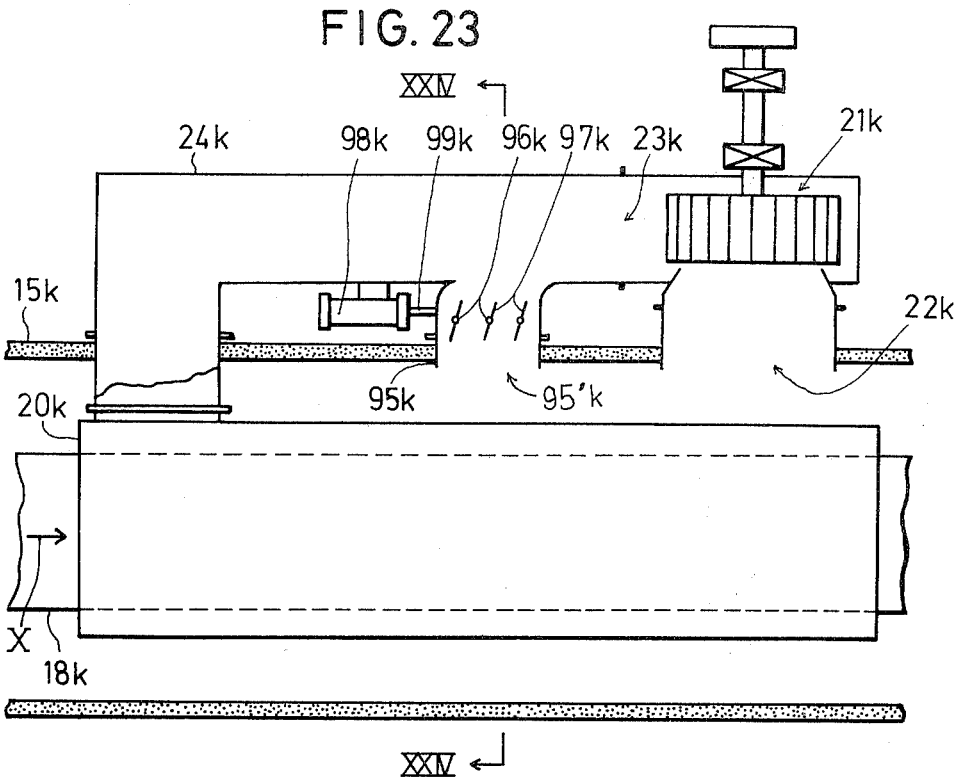
FIG. 23 is a horizontal cross section of a different combination of duct and discharge means from that of FIG. 21.
Figure 24:
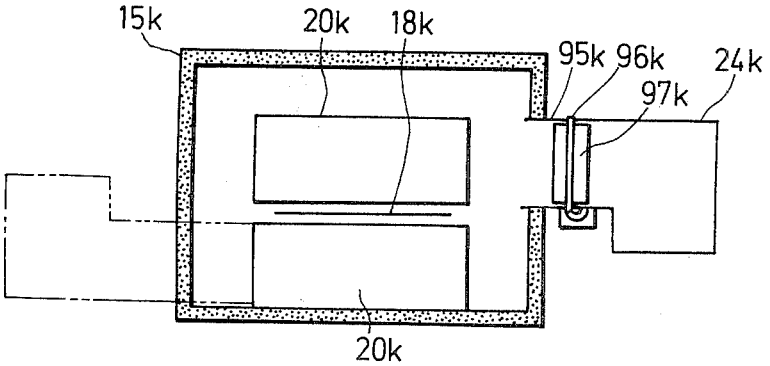
FIG. 24 is a cross section of the combination of FIG. 23 taken on the line XXIV—XXIV of FIG. 23.

Referring to FIGS. 23 and 24, a blast duct 24*k* is provided outside a furnace wall 15*k*, and is provided with a surplus-gas discharge means including three dumpers 97*k* for controlling the amount of surplus gas to be discharged. The dumpers 97*k* are all opened or closed simultaneously by the action of a cylinder 98*k*.

As many apparently widely different embodiments of the invention may be made without departing from the spirit and scope thereof, it is to be understood that the invention is not limited to the specific embodiments thereof except as defined in the appended claims.

What is claimed is:

1. A method for conveying strip materials while floating the strip by blowing jets of gases against the strip from a pair of chambers vertically separated from each other with a strip-conveyance passage disposed therebetween, including the steps of:

a. adjusting the width of blowoff of gas from the lower one of said chambers in accordance with the particular width of the strip to be conveyed; and b. controlling the rate of supply of gas to said lower chamber so that the speed of gas blown against the strip with said adjusted blowoff width is set at such a value as allows the strip to be floated in a steady manner.

2. A method in accordance with claim 1 wherein said adjustment of gas-blowoff width of said lower chamber is effected by moving a plurality of shutters along the top of said lower chamber including a plurality of blowoff openings and in directions perpendicular to the direction of strip conveyance.

3. A method in accordance with claim 1 wherein said adjustment of the speed of gas blown against the strip is effected by controlling the output of power of a gas supply means connected to said lower chamber.

4. A method for conveying strip materials while floating the strip by blowing jets of gases against the strip from a pair of chambers vertically separated from each other with a strip-conveyance passage disposed therebetween, including the steps of:

a. adjusting the width of blowoff of gas from the lower of said chambers in accordance with the particular width of the strip to be conveyed; and b. discharging a portion of the gas supplied into said lower chamber from outside said adjusted blowoff width so that the speed of the gas blown against the strip from said adjusted blowoff width is set at such a value as allows the strip to be floated in a steady manner.

5. A method in accordance with claim 4 wherein said gas-blowoff width is determined in a larger range than the width to be adjusted in accordance with the particular width of the strip and said discharge of a portion of the gas is effected from the portion of said determined blowoff width located outside of the blowoff width to be adjusted in accordance with the particular width of the strip.

6. A method in accordance with claim 4 wherein said discharge of a portion of the gas is effected from a discharge port located in a middle of a gas-supply pipe for said lower chamber.

* * * * *